US005615499A

United States Patent [19]

McGuire et al.

[11] Patent Number: 5,615,499

[45] Date of Patent: Apr. 1, 1997

[54] METHOD OF AND APPARATUS FOR TRENCHING

[76] Inventors: Christopher J. McGuire, 4678 Chimney Rock Rd., Dodgeville, Wis. 53533; Matthew P. McGuire, 1059 Circle Dr., Highland, Wis. 53543; Thomas W. Scholl, 2007 E. Windsor Pl., Milwaukee, Wis. 53202

[21] Appl. No.: 423,224

[22] Filed: Apr. 17, 1995

[51] Int. Cl.[6] ..... E02D 17/06

[52] U.S. Cl. ..... 37/367; 37/370; 37/380; 37/404; 37/468

[58] Field of Search ..... 37/366, 367, 370, 37/372, 330, 403, 404, 405, 406, 407, 408, 409, 410, 468; 405/15

[56] References Cited

U.S. PATENT DOCUMENTS

| | | | |
|---|---|---|---|
| 30,036 | 9/1860 | Atkinson | 37/370 |
| 51,067 | 11/1865 | Lugenbell et al. | 37/367 |
| 74,729 | 2/1868 | Standart | 37/366 |
| 187,466 | 2/1877 | Humphreys | 37/366 |
| 208,682 | 10/1878 | Humphreys | 37/367 |
| 483,476 | 9/1892 | Rinehart | 37/366 |
| 616,300 | 12/1898 | Esty | 37/367 |
| 1,848,635 | 3/1932 | Leriche et al. | 37/366 |
| 2,645,043 | 7/1953 | Booten et al. | 37/98 |
| 2,670,550 | 3/1954 | Bowen | 37/98 |
| 2,726,463 | 12/1955 | Rogers | 37/372 |
| 2,747,309 | 5/1956 | Cooper | 37/404 X |
| 2,864,184 | 12/1958 | Fohr | 37/142 |
| 2,916,835 | 12/1959 | Boyce | 37/98 |
| 3,999,315 | 12/1976 | Nye | 37/141 T |
| 4,597,205 | 7/1986 | Guest | 37/403 X |
| 4,704,811 | 11/1987 | Jefferson | 37/80 A |
| 4,892,155 | 1/1990 | Wanamaker | 172/199 |
| 5,273,375 | 12/1993 | Plourde | 404/118 |
| 5,377,766 | 1/1995 | Klinger | 172/782 |

*Primary Examiner*—Terry Lee Melius
*Assistant Examiner*—Victor Batson
*Attorney, Agent, or Firm*—Andrus, Sceales, Starke & Sawall

[57] ABSTRACT

An excavation apparatus adapted for connection to a tool of a construction vehicle comprises a framework having a proximal end and a distal end, the framework including a trenching device positioned intermediate the proximal end and the distal end for digging a furrow in which a silt fence is positioned. The proximal end has a mounting arrangement for clamping the framework to the tool of the construction vehicle and the distal end has a depth limiting arrangement for limiting the digging depth of the trenching device.

10 Claims, 2 Drawing Sheets

METHOD OF AND APPARATUS FOR TRENCHING

FIELD OF THE INVENTION

This invention relates broadly to trenching equipment, and deals more particularly with a trenching apparatus adapted for connection to the loading bucket of a construction vehicle for providing a furrow in which a silt fence is positioned.

BACKGROUND OF THE INVENTION

In any sort of construction work in which the earth is perturbed by any great amount, such as excavation for building foundations or altering topological grades, control methods are required to prevent erosion of the silt and soil such as caused by heavy rainfall. These control methods are particularly important to the building and road construction industry and generally involve the use of a barrier in the form of a silt fence to address the problems of silt, soil and sand run off.

In order to install the silt fence, it is necessary to cut a narrow trench at the excavation site. After the silt fence is manually positioned in the furrow, the berm of the displaced soil left by the trenching operation must be filled back into the furrow to sustain the position of the silt fence.

Presently available trenching machines are generally larger and more expensive than desired for a narrow trenching job. In addition, such machines are often difficult to maneuver and their digging depth is difficult to control. As a result, trenching operations required for positioning of the silt fence may often require more manual labor than is desired.

It is the general aim of the present invention to provide a relatively simple, easily transportable trenching attachment which may be readily attached to various sizes of an existing tool, such as an earth moving bucket, located on the front end of a construction vehicle such as a skid steer vehicle or front end loader. It is further desirable to provide a trenching attachment which may be operated at any location on an excavation site and will consistently form a furrow in the range of 4–7 inches deep. It is also within the purview of this invention to provide a trenching device which may be readily removed from the bucket in order to efficiently backfill the furrow and sustain the silt fence in place.

SUMMARY OF THE INVENTION

The present invention advantageously provides an improved excavation apparatus which converts an existing earth working bucket on a construction vehicle to a narrow trenching device. The trenching device is readily installed and removed from the bucket of the construction vehicle and permits the digging of furrows for the installation of silt fences used to prevent erosion at construction sites.

In one aspect of the invention, an excavation apparatus adapted for connection to a tool of a construction vehicle for providing a furrow in which a silt fence is positioned comprises a framework having a proximal end and a distal end, the framework including the trenching device positioned intermediate the proximal end and the distal end for digging the furrow in which the silt fence is positioned. The proximal end includes a mounting arrangement for clamping the framework to the tool of the construction vehicle and the distal end has a depth limiting arrangement for limiting the digging depth of the trenching device.

In another aspect of the invention, a trenching device for attachment to an earth working bucket provided on the front end of the vehicle comprises a rigid beam extending forwardly of the bucket, the beam having a right side, a left side, a proximal end and a distal end. A support assembly is spaced above and lies substantially parallel to the proximal end of the rigid beam and carries a mounting device for clamping the bucket inserted between the rigid beam and the support assembly against the rigid beam. A stabilizing member is disposed substantially transverse to the rigid beam and the support assembly and is engageable with a lower lip on the lower, forwardmost portion of the bucket. A moldboard is fixedly secured to the right side of the rigid beam between the proximal end and the distal end for digging a furrow as the vehicle advances. A skid plate is disposed on the distal end of the rigid beam at an acute angle with respect to the longitudinal centerline of the rigid beam and is guidable along a plane of the earth to limit the; digging depth of the moldboard.

In yet a further aspect of the invention, an attachment for plowing earth used in conjunction with a loading bucket mounted on the front end of a vehicle comprises a rigid framework having a proximal end and a distal end and a mounting arrangement for releasably securing the proximal end of the framework in a fixed position to a loading bucket mounted on the front end of the vehicle to move commensurately with the loading bucket and relative to the vehicle. The framework includes a stabilizing member engageable with the loader bucket to hold the framework firmly against the loader bucket. The framework also includes a trenching arrangement disposed to one side thereof intermediate the proximal end and the distal end for engaging the earth and digging a furrow as the vehicle is advanced. The framework further includes a skid plate mounted on the distal end thereof at an acute angle with respect to the longitudinal centerline of the framework and guidable along the plane of the earth to limit the digging depth of the trenching arrangement.

In yet another aspect of the invention, there is contemplated a method of using a plowing implement to move earth, the implement being adapted for releasable connection to a loader bucket of a construction vehicle for providing a furrow in which a silt fence is positioned. The method comprises the steps of: providing a framework movable with the construction vehicle and having a proximal end and a distal end, the framework including a trenching device positioned intermediate the proximal end and the distal end, the proximal end having a mounting arrangement for releasably clamping the framework to the bucket of a construction vehicle and the distal end having a depth limiting arrangement for limiting the motion of the trenching device; advancing the construction vehicle along a digging path such that the trenching device will engage the earth and form a furrow, as governed by the depth limiting arrangement, the displaced earth from the furrow forming a berm; positioning a silt fence upright in the furrow; releasing the framework from the bucket using the mounting arrangement; and advancing the construction vehicle again along the digging path, the bucket being filled with earth such that the earth in the bucket will displace the earth from the berm back into the furrow as the bucket advances to sustain the position of the silt fence.

BRIEF DESCRIPTION OF THE DRAWINGS

The invention will become better understood by reference to the following detailed description of the preferred exemplary embodiment when read in conjunction with the appended drawing wherein like numerals denote like elements.

DETAILED DESCRIPTION OF THE PREFERRED EMBODIMENTS

Figure 1:
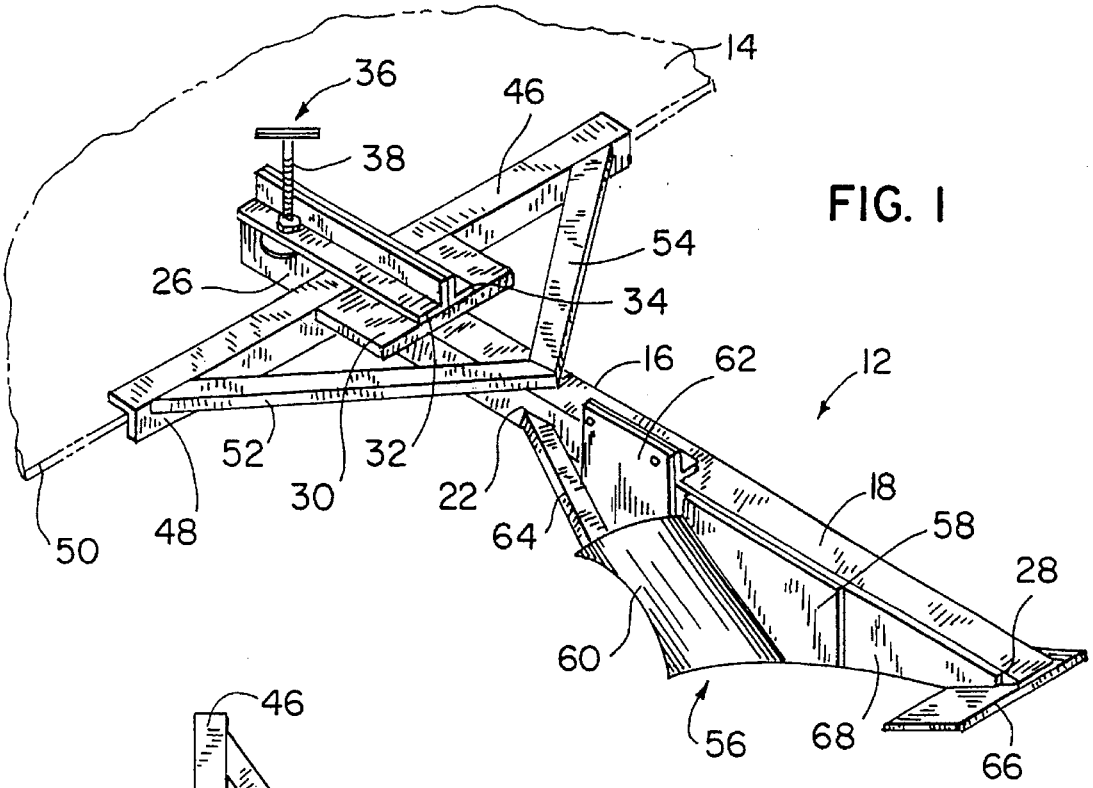
FIG. 1 is a perspective view of the excavation attachment embodying the present invention.
Figure 2:
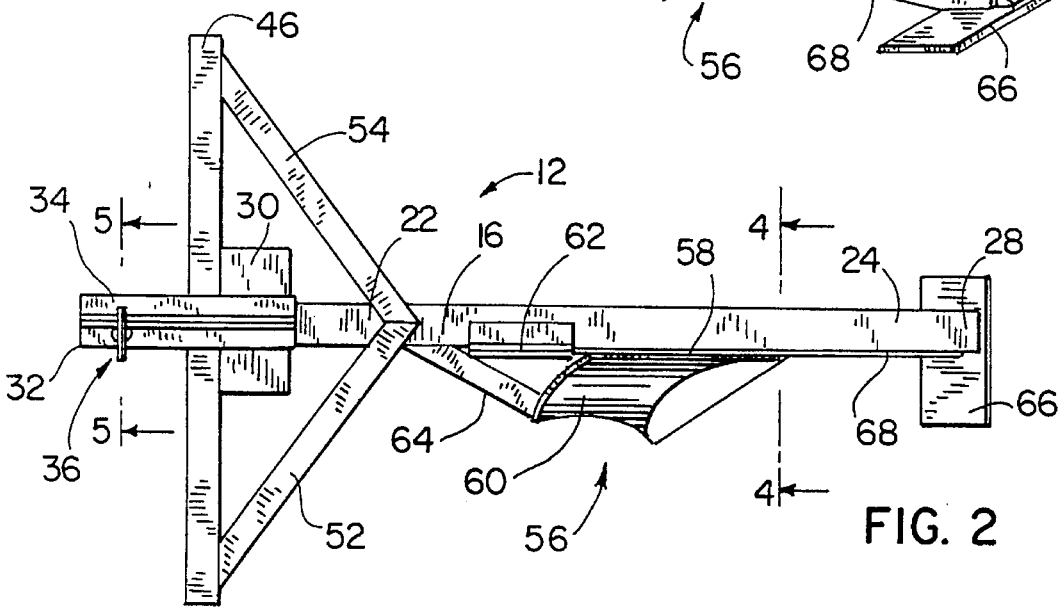
FIG. 2 is a top view of the excavation attachment shown in FIG. 1.
Figure 3:
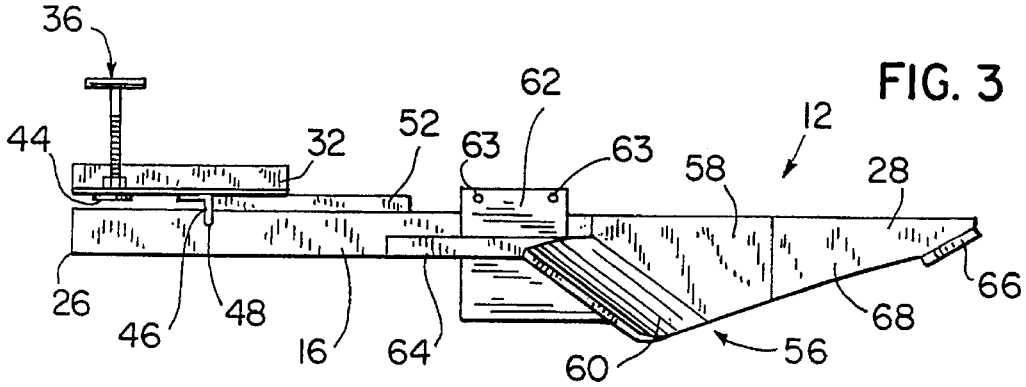
FIG. 3 is an elevational view of the excavation attachment shown in FIG. 1.
Figure 5:
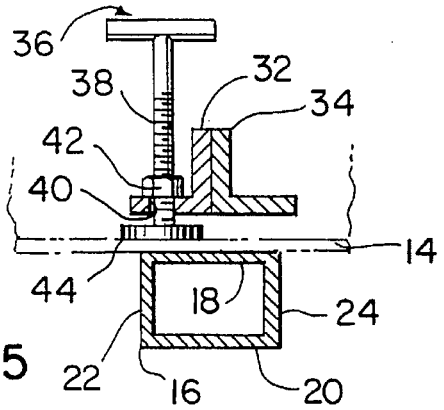
FIG. 5 is a cross-sectional view taken on line 5—5 of FIG. 2.
Figure 4:
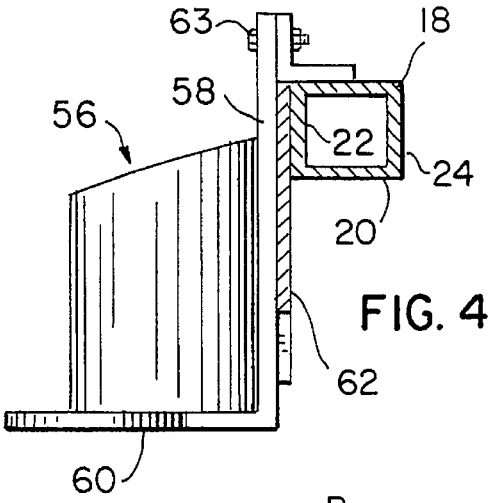
FIG. 4 is a cross-sectional view taken on line 4—4 of FIG. 2.

In the drawings and description which follow, an excavation apparatus embodying the present invention and generally identified by the reference numeral 12 is shown releasably mounted to a tool or earth moving bucket 14 of a construction vehicle such as a front end loader or skid steer vehicle. As is well known, the construction vehicle includes suitable controls (not shown) for controlling the movement and orientation of the bucket 14.

Examining the excavation apparatus 12 of FIGS. 1–5 in greater detail, it is preferably fabricated of a heavy duty, welded metal construction and includes a rigid framework in the form of a substantially square or rectangular beam or angle iron 16 extending forwardly of bucket 14. Beam 16 has a top 18, a bottom 20, a right side 22, a left side 24, a proximal end 26 and a distal end 28. The proximal end 26 of beam 16 carries along its top 18 a filler plate 30 on the upper surface of which a support assembly formed by two back-to-back angle irons 32, 34 is positioned. Angle iron 32 provides support for a mounting device 36 used to releasably secure the framework to bucket 14. Mounting device 36 comprises a rotatable T bolt assembly having a T shaft 38 which passes through an aperture 40 drilled in angle iron 32 and which is threadably adjustable in a nut 42 straddling the aperture 40. The bottom of shaft 38 is provided with a circular pressure plate 44 which is rotatably adjusted towards and away from the bucket 14 inserted between angle irons 32, 34 and beam 16 to clamp bucket 14 between pressure plate 44 and beam 16 as shown best in FIG. 5.

A stabilizing member 46 in the form of an angle iron is disposed substantially transverse to and mounted on beam 16 and has a leg 48, the forward side of which abuts filler plate 30. The rearward side of leg 48 interfaces against a lip 50 on the lower, forwardmost portion of bucket 14 over substantially the entire width thereof. The framework includes a pair of support gussets 52, 54, each of which extend at an angle from an end of stabilizing member 46 to the top of beam 16 at a position spaced slightly forwardly of filler plate 30 and angle irons 32, 34.

A trenching device 56 in the form of a moldboard is welded or otherwise fixedly secured to the right side 22 of beam 16 intermediate proximal end 26 and distal end 28 for digging a narrow trench as the vehicle advances. Moldboard 56 includes a vertically disposed planar portion 58 and a curved, flared portion 60. A reinforcing plate assembly 62 extending above and below the right side 22 of beam 16 behind moldboard 56 is secured to beam 16 by removable fasteners 63. To further add support, a reinforcing strut 64 extends from the rearmost edge of moldboard 56 to right side 22 of beam 16 slightly forward of the junction between support gussets 52, 54. A skid plate 66 disposed at an acute angle of approximately 30° from the longitudinal centerline of beam 16 serves as a depth limiting arrangement for limiting the depth of trenching device 56. To provide greater support, the right side 22 of beam 16 includes an enlarged portion 68 extending along the distal end 28. Portion 68 defines an angled lower edge which functions to "slice" turf as apparatus 12 advances to prevent build-up of turf on the forward edge of vertical portion 58.

Figure 6:
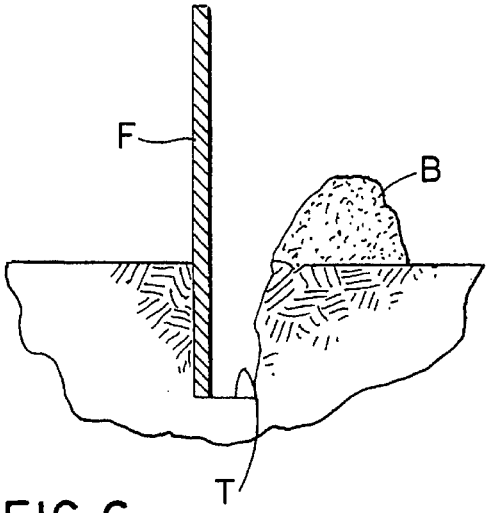
FIG. 6 is a representation of a silt fence positioned in an excavation formed by the present invention.
Figure 7:
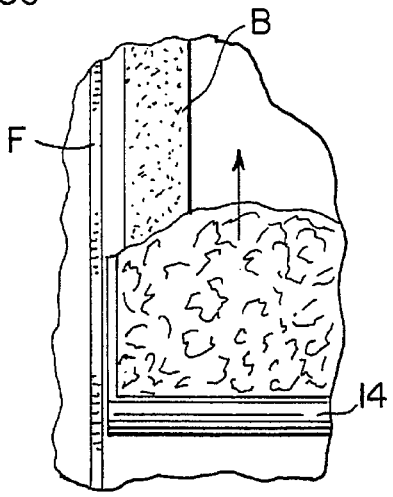
FIG. 7 is an illustration showing the technique used in replacing the excavated soil shown in FIG. 6.

In use, excavation apparatus 12 is clamped to bucket 14 using mounting device 36 and making sure stabilizing member 46 is held tightly against the lip 50 of bucket 14. With the lower surface of bucket 14 positioned at the desired trenching angle to and spaced slightly above the plane of the earth to be excavated, the construction vehicle is advanced along the digging path such that the trenching device 56 will cut a narrow trench T (FIG. 6) on the right side of the apparatus, the displaced earth forming a berm B next to trench T. Ideally, the depth of the trench T is 4–7 inches, such parameter being held in a relatively constant range by the angular disposition (i.e. 30° relative to the longitudinal centerline of beam 16) of skid plate 66. After trench T has been formed, construction workers initially position a silt fence F upright against the wall of the trench T. When the trenching operation is concluded, apparatus 12 is releasably removed from bucket 14 by unscrewing mounting device 36. Then, as seen in FIG. 7, bucket 14 is filled with earth and the construction vehicle retraces along the original digging path, the large surface area provided by earth in the advancing bucket 14 used to push against the berm B and replace soil in the furrow to sustain the upright position of silt fence F.

Figure 8:
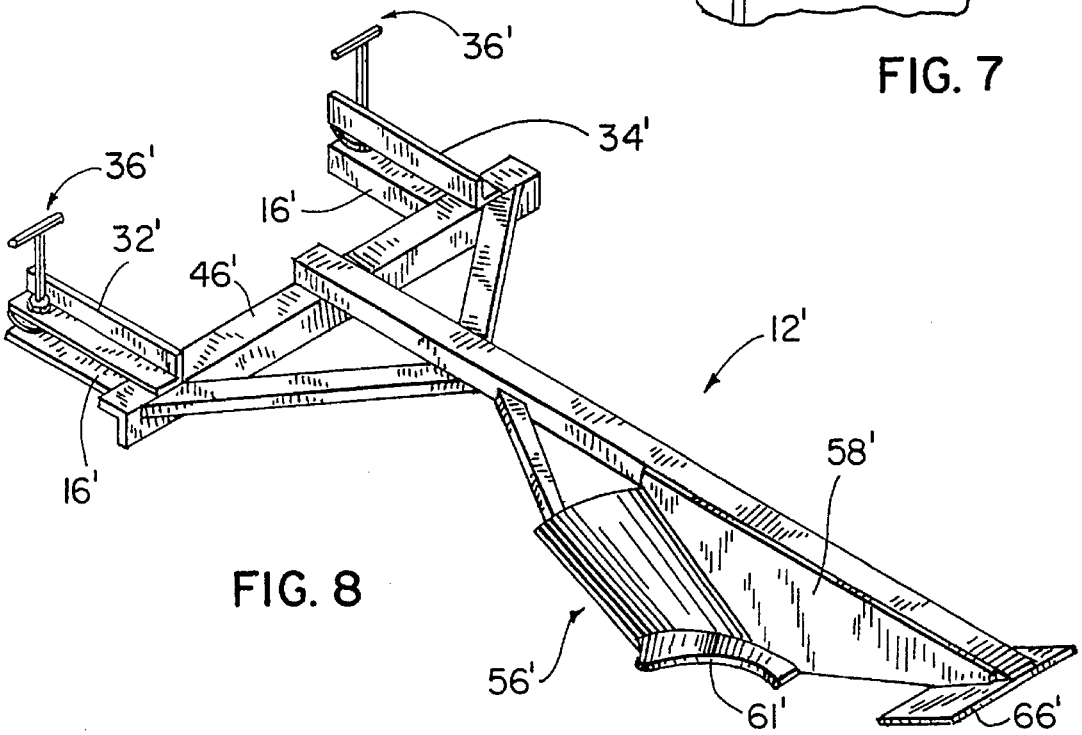
FIG. 8 is a perspective view of an alternative embodiment of the present invention.

FIG. 8 shows an alternative embodiment of the invention in which two mounting devices 36' are utilized to provide a greater mounting stability for the trenching attachment. In this embodiment, one mounting device 36' is supported on an angle iron 32' for clamping the bucket against a beam extension 16' projecting from stabilizing member 46'. The other mounting device 36' is supported from angle iron 34' for clamping the bucket against another beam extension 16' projecting from stabilizing member 46'. In addition, the planar portion 58' of trenching device 56' is enlarged to serve as a greater mounting surface for attachment to beam 16. Planar portion 58' defines an angled front edge which extends entirely between skid plate 66' and moldboard lower lip 61'.

It should be appreciated that the present invention provides an improved plowing or trenching attachment which will enable a controlled range of trenching without complicated mechanical or hydraulic components. It should be further understood that the present invention enables a relatively consistent trenching operation which may be easily started and stopped according to movement of the construction vehicle. It should also be understood that the simplified yet effective installation and removal of the trenching apparatus saves time and effort normally expended in prior art trenching operations on construction sites. Due to the relatively manageable weight (approximately 125 lbs.) of excavation apparatus 12, it generally requires one worker only a few minutes time to complete installation and removal on the bucket of the construction vehicle. At the same time, it should be noted that the combination of the mounting device 36 and stabilizing member 46 used during installation, removal and trenching operations is intended to provide positive securement without inflicting damage to the bucket or construction vehicle.

While the invention has been described with reference to a preferred embodiment, those skilled in the art will appreciate that certain substitutions, alterations and omissions may be made without departing from the spirit thereof. For example, various types of trenching devices may be used in place of moldboard 56. Likewise, different depth limiting arrangements other than skid plate 66 may be employed as desired. Accordingly, the foregoing description is meant to be exemplary only, and should not be deemed limitative on the scope of the invention set forth with the following claims.

We claim:

1. A trenching device for attachment to a lower portion of an earth working bucket provided on the front end of a vehicle, the device comprising:

a rigid beam extending forwardly of the bucket, said beam having a right side, a left side, a proximal end and a distal end;

a support assembly spaced above and lying substantially parallel to the proximal end of said rigid beam, said support assembly carrying a mounting device for clamping the bucket inserted between said rigid beam and said support assembly against said rigid beam;

a stabilizing member disposed substantially transverse to said rigid beam and said support assembly and engageable with a lower lip on the lower, forwardmost portion of the bucket;

a moldboard fixedly secured to a side of said rigid beam between said proximal end and said distal end for digging a furrow as the vehicle advances; and a skid plate disposed on the distal end of said rigid beam at an acute angle with respect to the longitudinal centerline of said rigid beam and guidable along a plane of the earth to limit the digging depth of said moldboard, wherein said mounting device comprises a T bolt assembly threadably positioned in said support assembly, said T bolt assembly having a flat pressure plate at the bottom thereof rotatably adjustable with respect to said lower portion of said bucket and clamping the bucket to and directly against said rigid beam such that the longitudinal axis of said T bolt assembly is substantially perpendicular to said support assembly said lower portion of said bucket and said beam.

2. The device of claim 1, wherein said moldboard includes reinforcement means connected at a rearward end thereof.

3. The device of claim 1, including a filler plate positioned on said rigid beam abutting said stabilizing member.

4. An attachment for plowing earth used in conjunction with a loading bucket mounted on the front end of a vehicle, said attachment comprising:

a rigid beam having a proximal end and a distal end;

mounting means for releasably securing said proximal end of said beam in fixed, cantilevered position to a loading bucket mounted on the front end of a vehicle to move commensurately with the loading bucket and relative to the vehicle, said mounting means comprising a rotatable bolt having an integral flat pressure plate engageable with a upper surface of said loading bucket upon rotation of said bolt to clamp said loading bucket downwardly against said beam;

said beam including stabilizing means engageable with a lower lip of the loading bucket when said pressure plate is engageable with the top of said loading bucket to hold said beam firmly against the loading bucket;

said beam including trenching means disposed to one side thereof intermediate said proximal end and said distal end for engaging the earth and digging a furrow as the vehicle is advanced; and said beam including skid plate means mounted on said distal end thereof at an acute angle with respect to the longitudinal centerline of said beam and guidable along the plane of the earth to limit the digging depth of said trenching means.

5. The attachment of claim 4, wherein said stabilizing means comprises a single angle iron engageable with a lower lip on the lower, forwardmost portion of the bucket along substantially the entire width thereof.

6. The attachment of claim 4, wherein said trenching means comprises a moldboard.

7. The attachment of claim 4, wherein said skid plate is oriented at a 30° angle with respect to the longitudinal centerline of said beam.

8. A method of using a plowing implement to move earth, said implement being adapted for releasable connection to a loader bucket of a construction vehicle for providing a furrow in which a silt fence; is positioned, said method comprising the steps of:

providing a framework movable with the construction vehicle and having a proximal end and a distal end, said framework including a trenching device intermediate said proximal end and said distal end, said proximal end having a mounting arrangement for releasably securing said framework to the bucket of the construction vehicle and said distal end having a depth limiting arrangement for limiting the motion of said trenching device;

advancing the construction vehicle along a digging path such that said trenching device will engage the earth and form a furrow, as governed by said depth limiting arrangement, the displaced earth from said furrow forming a berm;

positioning a silt fence upright in said furrow;

releasing said framework from the bucket using the mounting arrangement; and advancing the construction vehicle again along the digging path, the bucket being filled with earth such that the earth in the bucket will displace the earth from the berm back into the furrow as the bucket advances to sustain the position of said silt fence.

9. The method of claim 8, wherein the step of advancing the construction vehicle along a digging path such that said trenching device will engage the earth and form a furrow includes setting said depth limiting arrangement to provide a furrow having a depth in the range of 4–7 inches.

10. Excavation apparatus for connection to a tool of a construction vehicle for providing a furrow, said apparatus comprising:

a frame having a proximal end and a distal end, said frame including a ground engaging trenching device intermediate said proximal end and said distal end for digging the furrow, said proximal end having a mounting arrangement for releasably securing said frame to the tool of the construction vehicle and said distal end having a depth limiting arrangement for limiting the depth of digging, wherein said trenching device comprises:

a first generally vertical planar section connected to said frame, said first planar section being formed with a cutting edge;

a second generally vertical planar section connected to said frame between said first planar section and said depth limiting arrangement, said second planar section being formed with a second cutting edge; and a curved section extending rearwardly of and flaring outwardly from said second planar section.

* * * * *

UNITED STATES PATENT AND TRADEMARK OFFICE

CERTIFICATE OF CORRECTION

PATENT NO. : 5,615,499

DATED : April 1, 1997

INVENTOR(S) : McGuire et al.

It is certified that error appears in the above-indentified patent and that said Letters Patent is hereby corrected as shown below:

CLAIM 1, Col. 5, Line 38, after "assembly" insert --,--; CLAIM 8, Col. 6, Line 15, after "fence" delete ","; CLAIM 10, Col. 6, Line 59 after "a" and before "cutting" insert --first--."

Signed and Sealed this

Twenty-fourth Day of June, 1997

Bruce Lehman

*Attest:*

BRUCE LEHMAN

*Attesting Officer*

*Commissioner of Patents and Trademarks*